United States Patent [19]

Eriksson et al.

[11] Patent Number: 4,508,566

[45] Date of Patent: Apr. 2, 1985

[54] METHOD OF CLEANING A GAS FLOW CONTAINING ZINC VAPOR

[75] Inventors: Sune Eriksson; Sven Santén, both of Hofors; Gotthard Björling, Djursholm, all of Sweden

[73] Assignee: SKF Steel Engineering Aktiebolag, Sweden

[21] Appl. No.: 460,500

[22] Filed: Jan. 24, 1983

[30] Foreign Application Priority Data

Jun. 21, 1982 [SE] Sweden ..... 8203831

[51] Int. Cl.[3] ..... C22B 19/04

[52] U.S. Cl. ..... 75/88; 75/14

[58] Field of Search ..... 75/14, 88

[56] References Cited

U.S. PATENT DOCUMENTS

| | | | |
|---|---|---|---|
| 1,994,345 | 3/1935 | Holstein et al. | 75/88 |
| 3,448,972 | 6/1969 | Derham | 266/148 |
| 3,841,862 | 10/1974 | Benatt et al. | 75/88 |
| 3,975,188 | 8/1976 | Harvey et al. | 75/88 |

*Primary Examiner*—M. J. Andrews

*Attorney, Agent, or Firm*—Brumbaugh, Graves, Donohue & Raymond

[57] ABSTRACT

A gas mixture obtained from reduction of material containing zinc oxide in a furnace, is cleaned from accompanying vapor of metals or compounds having a boiling point higher than zinc and from accompanying dust particles by cooling the hot gas mixture to almost the saturation temperature of zinc vapor by the introduction therein of solid or liquid metal.

5 Claims, 2 Drawing Figures

METHOD OF CLEANING A GAS FLOW CONTAINING ZINC VAPOR

DESCRIPTION

Figure 1:
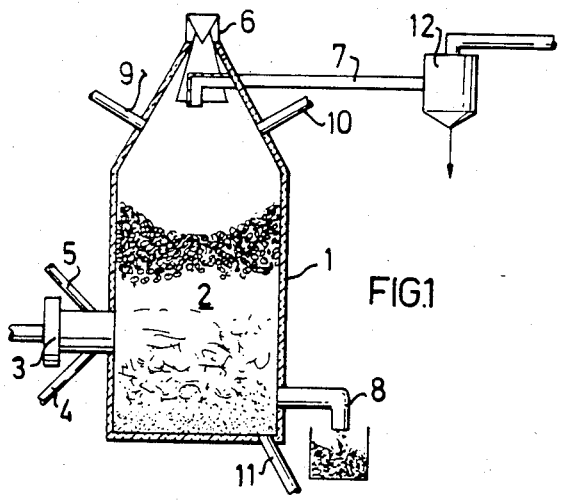

The present invention relates to a method of cleaning a gas mixture obtained from reduction of material containing zinc oxide in a furnace, from accompanying vapour of metals or compounds having a boiling point higher than zinc and from accompanying dust particles.

When producing zinc thermally by the reduction of zinc oxide, a gas mixture is obtained from which liquid zinc is then recovered by means of condensation. This latter apparently simple process step is in fact rather complicated. The importance of preventing re-oxidation of zinc vapour due to the influence of carbon dioxide and water vapour when the temperature drops, may be mentioned as an example.

The gas mixture, which contains zinc vapour, leaving the reduction, is over-heated in relation to the saturation pressure of the zinc. It also contains vapour from other metals and compounds, as well as dust particles. All these factors complicate subsequent condensation by causing the formation of dross on the surface of the metal in the condensor. Dross is the term for the solid contaminants separated out when the temperature drops.

It has therefore been a requirement to enable the gas mixture containing zinc vapour to be pre-cooled so that the condensor need not act to a great extent as gas cooler and be designed as such, and also to offer potentially more efficient condensation and the acquisition of purer liquid zinc in the condensor. Normally the gas mixture leaving a reduction zone for zinc oxide has a temperature of at least 1200° C.

The space in a reduction furnace is restricted and since considerable quantities of heat must be removed quickly, there must be a large cooling surface available. This cannot be achieved in practice by the insertion of cooling elements in the gas flow, partly because they would take up too much space, and partly because there is no suitable material for efficient heat transfer at temperatures in the vicinity of 1200° C.

According to the present invention, the hot gas mixture is cooled to almost the saturation temperature of zinc by introducing or contacting with a quantity of cold, generally relatively easily melted, metal, such as zinc or lead. Such metal will in the following be termed cooling metal, or cooling zinc or lead, respectively, and it can be introduced in either solid or liquid form. The cooling metal may suitably comprise a part of the metal produced by the process.

The gas mixture is most efficiently cooled by the considerable transfer of heat from the hot gas to cold, finely powdered cooling metal. Zinc is most efficient as cooling metal since, after possible melting and heating to vaporization temperature, it can absorb large quantities of heat by vaporization until its thermal equilibrium is reached when the gas mixture contains saturated zinc vapour. It may be advantageous to use a slight excess of cooling zinc as this excess can dissolve vapour of metals having lower vapour pressure than zinc, such as lead and tin.

The vaporized cooling zinc is recovered in a condensor and can be recirculated after cooling. In this case, the condensor must be dimensioned so that its cooling system can remove the excess heat in the hot furnace gas.

If the cooling metal consists of lead a greater quantity must be used since the cooling lead should not be vaporized. It may seem to be a drawback to have to use more cooling metal. However, it is very easy to circulate lead by using a pump and furthermore, the excess heat can be returned to the reaction zone where the endothermic reactions take place and the cooling lead thus evens out the temperature distribution in this zone. After cooling to condensation temperature, the cooling lead will absorb zinc metal and function as described for cooling zinc. Finally, it should be mentioned that for the removal of excess heat from the gas mixture, the construction of a cooler for circulating lead may be simpler than increasing the dimensions of a zinc condensor.

Since the gas mixture is cooled rapidly to a temperature below the condensation point for zinc, the zinc vapour will be momentarily sub-cooled. It will thus tend to condense on dust particles in the gas, increasing their size and thus enabling them to be mechanically separated from the gas mixture in a cyclone, for instance. The product thus extracted prior to the main condensation process can then advantageously be recirculated in the reduction process.

The zinc content can now be condensed from the cleaned gas mixture containing saturated zinc vapour in a conventional condensor, giving a satisfactory yield.

In practice the cooling metal can be added to the hot gas in various ways. According to one embodiment of the invention the cooling metal is introduced in the reduction furnace above the actual reduction zone, the cooling metal running down in counter-flow to the rising gas mixture, cooling it on the way. Metals having lower vapour pressure than zinc, such as lead, tin and silver, are thus condensed in the cooling metal and, once the excess zinc—both cooling zinc and zinc condensed in the cooling metal—has been distilled during its downward passage through the hotter zones, these metals will be collected at the bottom of the furnace where they can be tapped off together with the work lead.

According to another embodiment of the invention the cooling metal is added at a later stage in a part separate from the reduction furnace so that the cooling metal contaminated during cooling cannot flow back into the reduction furnace. This is advisable when the charge contains substances like arsenic and chlorides, which are likely to damage the quality of the zinc. If cooling zinc is used, lead can be segregated and returned to the reduction process after separation from the damaging constituents.

The invention is applicable to all types of zinc reduction furnaces. In certain respects, it is best suited for furnaces or reactors through which the charge passes continuously due to gravity as in the case of New Jersey vertical retorts, furnaces heated by passing electric current through the charge in accordance with St. Joseph Zinc, Imperial Smelting shaft furnaces or SKF Steel PLASMAZINC® furnaces. The invention is of most value in methods where the remainder, after reduction and vaporization of the zinc, is tapped off in liquid form, and its application will therefore be discussed particularly with respect to the PLASMAZINC® method.

Figure 2:
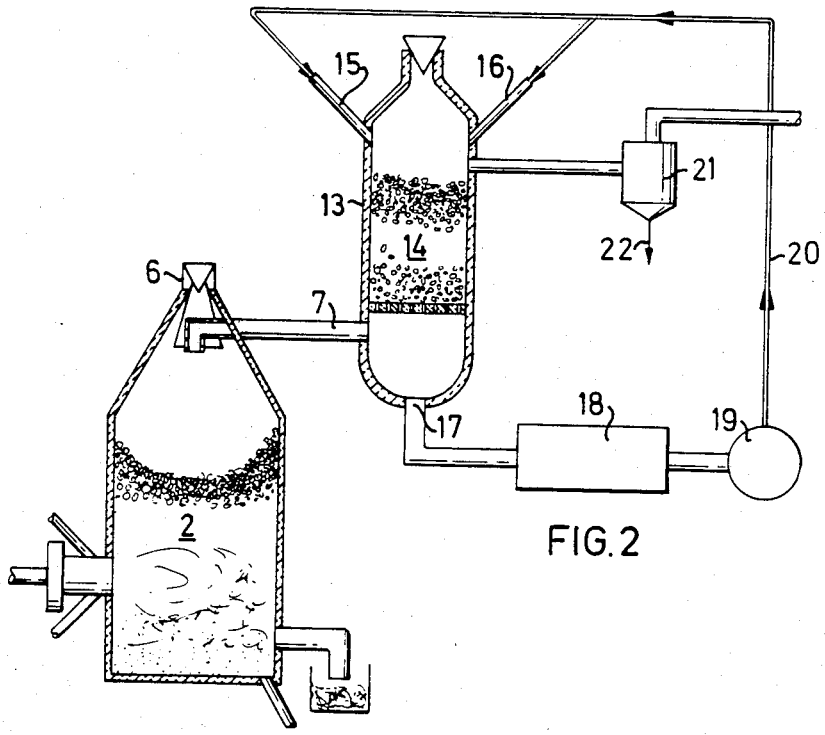

Further advantages and features of the invention will be revealed in the following detailed description with reference to the accompanying drawings, in which:

FIG. 1 shows schematically a first embodiment of the invention where the cooling takes place at the top of the reactor itself, and FIG. 2 shows a second embodiment of the invention, where the cooling takes place separately from the reduction furnace.

In FIG. 1, 1 denotes a furnace for the reduction of material containing zinc oxide in accordance with the PLASMAZINC® method. The reactor contains a charge 2 of coke. The plasma generators 3 (only one is shown in the drawing) are arranged in the lower part of the reactor with supply means 4, 5 for the material containing zinc oxide and the reducing agent, respectively. The plasma generators are normally arranged in threes, i.e. 3 or 6, in a reduction furnace of the type described. At the top of the reactor is a blast furnace top 6 for the supply of coke to keep the coke charge 2 continuously over a certain minimum level. An outlet pipe 7 leads from the top of the reactor for gas leaving the process.

A slag outlet 8 is arranged at the bottom of the reactor where non-liquid metals ca also be removed.

According to the invention means 9, 10 are arranged for the supply of cooling metal above the coke charge in the reactor. The plasma generators may be arranged asymmetrically so that a cooler zone is formed close to one part of the reactor wall. The function of the equipment is described in detail below.

A plasma is generated by the generator 3 by the passage of a suitable gas, such as air, recirculated reduction gas, etc., and an extremely hot gas mass is obtained. Starting material containing zinc oxide and a reducing agent are introduced into this hot gas mass. The starting material may be roasted zinc concentrates with a typical content of 50% ZnO, 20% PbO, or furnace dust from other processes containing 20% ZnO, 2% PbO, for instance. The reducing agent should contain carbon such as hydrocarbon in liquid or gaseous form or coke dust.

A reaction room is burned out in front of the plasma generator 3, in which oxides introduced are reduced and volatile metals are vaporized; the temperature there is about 1800° C.

Metals difficult to volatize are collected up in the slag at the bottom of the reactor and tapped off through the outlet 8. Metals which can be reduced but which have low vapour pressure are collected in the bottom of the furnace below this slag. The rising gas mixture is cooled somewhat but generally has a temperature of at least 1200° C. on reaching the top of the reactor and must therefore be pre-cooled. Besides zinc vapour, the gas mixture used for treating relevant zinc raw products also contains vapour of other metals, almost always including lead.

According to the invention liquid or solid cooling metal is supplied through the supply means 9, 10 so that the descending atomized metal meets the ascending gas. The gas is cooled, heating and possibly melting the metal and, in the case of cooling zinc, vaporizing the zinc. Metals having a high boiling point, such as lead and silver, are thus condensed. Since the cooling zone is located in the reactor itself, these condensed phases will run down again through the reactor, preferably beside the high temperature zone closer to the furnace wall, and then be removed from the bottom of the reactor through an outlet 11. Any zinc accompanying these condensed phases will be vaporized again during its passage through the hot reaction gas flowing in the opposite direction.

The temperature of the gas mixture after cooling should be such that zinc vapour contained therein is substantially saturated. In the case of gas rich in dust, it should even be over-saturated as described above.

After pre-cooling the gas mixture leaves the reactor through the outlet pipe 7. Preferably, the gas is then cooled somewhat further so that a small proportion of the zinc is precipitated on any dust particles present. These can then more easily be separated off in a cyclone 12. The gas is then fed into a condensor of conventional type so that the problem of dross formation, if not completely eliminated, will be substantially reduced.

FIG. 2 illustrates a second embodiment of the invention in which the gas mixture is cooled outside the reduction furnace. This method is to be recommended particularly if the gas mixture is much polluted, as mentioned earlier. Examples of contaminants which should not be concentrated in the reactor are chlorides and certain other substances such as arsenic. In this case, the hot gas mixture is allowed to flow out through the pipe 7 and into a separate cooler 13. The cooler 13 may of course constitute a part of the reactor top, although still separate from the actual reactor space, so that the condensed phase cannot run down again through the reactor.

The above-mentioned cooler 13, preferably in the form of a column filled with coke 14, is supplied with atomized solid or liquid cooling metal through the supply means 15, 16 in suitable manner, preferably in counter-flow to the gas mixture. Excess cooling metal with the metals, etc. condensed therein is separated and runs down in the column. The cooling metal leaves the column 13 through an outlet 17 in its bottom and is thereafter permitted to pass a cooler 18 before being returned to the supply means 15, 16 at the top of the column 13 through a pipe 20 provided with a pump 19. The gas mixture continues to the cyclone 21 for separation 22 of dust in accordance with the method described above.

The material extracted in the cooler 13 is then treated further in suitable manner. Possibly after being treated to remove undesired constituents, the dust mixed with zinc extracted in the cyclone 21 can be returned to the reaction zone in the reduction furnace.

The temperature of the gas leaving the reactor or cooler can suitably be used to control the process. The output in the plasma generators is generally fixed. The factor which can be regulated is the quantity of cooling metal supplied in relation to the quantity of starting material. The desired temperature of the gas leaving is determined, if the plasma energy is constant, by the quantity of constituents able to undergo endothermic reactions. If the heat consumption in the reaction zone should decrease for some reason, the gas leaving will become over-heated, and this can quickly be compensated by the addition of more cooling metal.

Two examples are given below to further illustrate the invention.

EXAMPLE 1

A dust containing 10% Zn, 2% Pb and 50% Fe in the form of oxides was fed into a coke-filled shaft and treated in accordance with the PLASMAZINC® method.

The gas generated has a temperature of 1200° C. in the upper part of the shaft, and the following composition:

| | |
|---|---|
| CO | 71.8% |
| $H_2$ | 23% |
| $N_2$ | 1% |
| $Zn_{(g)}$ | 4% |
| Pb | 0.2% |

The heat content in the above gas at 1200° C. was 1708 MJ/1000 $m^3$(n) (corresponding to 474 kWh/1000 $m^3$(n)).

As is clear from the vapour pressure curve for zinc vapour, this gas is extremely over-heated in relation to the partial pressure of zinc vapour and must therefore be drastically cooled before condensation. Previously this has been done in the condensor which meant that it had to be over-dimensioned. By cooling the gas to 950° C. or 750° C., for instance, according to the invention, the condensor can be made many times smaller.

At 950° C. said gas has a heat content of 1393 MJ/1000 $m^3$(n) and at 750° C. it has a heat content of 1144 MJ/1000 $m^3$(n).

The cooling requirement from 1200° C. to 950° C. is thus 315 MJ and to 750° C. 564 MJ, calculated on 1000 $m^3$(n) gas.

The following Table shows the quantity of circulating metal required for cooling in the two cases mentioned above when using lead and liquid zinc, respectively.

TABLE

| | kg circulated metal/1000 $m^3$(n) gas | |
|---|---|---|
| | Pb | Zn |
| 1200° C.–950° C. | 3600 | 161 |
| 1200° C.–750° C. | 10400 | 314 |

As is clear from the Table, zinc is a more efficient cooling medium than lead.

EXAMPLE 2

A dust containing 20% Zn, 5% Pb and 25% Fe in the form of oxides was fed into a shaft furnace exactly as in Example 1 and also treated in accordance with the PLASMAZINC® method.

In the upper part of the shaft the gas generated had a temperature of 1200° C. and the following composition:

| | |
|---|---|
| CO | 67% |
| $H_2$ | 21% |

-continued

| | |
|---|---|
| $N_2$ | 1% |
| $Zn_{(g)}$ | 10% |
| $Pb_{(g)}$ | 1% |

The heat content per 1000 $m^3$(n) in the above gas at 1200° C. was 2065 MJ, at 950° C. the heat content was 1745 MJ and at 750° C. it was 1496 MJ.

The cooling requirement to cool 1000 $m^2$(n) gas to 950° C. is thus 320 MJ and to 750° C. 569 MJ.

The cooling requirement for this composition of gas is thus approximately the same as for that in Example 1, and the same quantities of lead or zinc, respectively, are required for cooling.

The use of zinc in powder form enables the zinc consumption to be reduced by up to a further 10%.

We claim:

1. A method of purifying and cooling a superheated gas mixture containing zinc vapor together with vapor of at least one metal having a boiling point higher than zinc, said gas mixture being obtained from reduction in a reduction shaft of material containing zinc oxide, comprising the steps of reducing the zinc oxide in the reduction shaft so as to obtain said superheated gas mixture, passing the gas mixture upwardly through said reduction shaft, contacting said gas mixture with a countercurrent flow of cooling metal droplets or particles by injecting said cooling metal droplets or particles into the top of the shaft, said material containing zinc oxide at least partially not comprising said metal droplets or particles, and thereby condensing the vapor of said at least one metal having a boiling point higher than zinc and cooling the zinc containing gas to almost the saturation temperature of the zinc vapor in said gas, passing the condensed metal downwardly through the shaft and passing the cooled zinc vapor to a condensor outside the shaft and condensing said vapor.

2. Method according to claim 1, in which the metal added for cooling purposes consists of zinc which is thereby vaporized and then recovered in a condensor.

3. Method according to claim 1, in which the metal added for cooling purposes consists of lead which is subsequently removed from the system and recirculated after cooling.

4. Method according to claim 1 which also comprises the step of further cooling the gas mixture so as to condense a small quantity of zinc on dust particles from the reduction furnace which may be contained in the gas mixture so as to facilitate the mechanical separation if the dust particles from the gas mixture.

5. Method according to claim 4 which comprises the additional step of injecting the dust separated from the gas mixture into the reduction shaft.

* * * * *